US011149750B2

(12) United States Patent
Takei et al.

(10) Patent No.: US 11,149,750 B2
(45) Date of Patent: Oct. 19, 2021

(54) SILENCING DEVICE, ROTARY MACHINE, AND METHOD FOR MANUFACTURING SILENCING DEVICE

(71) Applicant: MITSUBISHI HEAVY INDUSTRIES COMPRESSOR CORPORATION, Tokyo (JP)

(72) Inventors: Yoshiko Takei, Tokyo (JP); Toshifumi Kudo, Tokyo (JP); Hirofumi Higuchi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 139 days.

(21) Appl. No.: 16/469,391

(22) PCT Filed: Nov. 20, 2017

(86) PCT No.: PCT/JP2017/041662
§ 371 (c)(1),
(2) Date: Jun. 13, 2019

(87) PCT Pub. No.: WO2018/116722
PCT Pub. Date: Jun. 28, 2018

(65) Prior Publication Data

US 2020/0096007 A1 Mar. 26, 2020

(30) Foreign Application Priority Data

Dec. 19, 2016 (JP) ..... JP2016-245438

(51) Int. Cl.
*F04D 29/66* (2006.01)
*B21K 3/00* (2006.01)
*F04D 29/42* (2006.01)

(52) U.S. Cl.
CPC ..... *F04D 29/663* (2013.01); *B21K 3/00* (2013.01); *F04D 29/4206* (2013.01)

(58) Field of Classification Search
CPC .... F04D 29/663; F04D 29/665; F04D 29/441; F04D 17/122
See application file for complete search history.

(56) References Cited

U.S. PATENT DOCUMENTS 6,550,574 B2 4/2003 Liu
6,983,820 B2 * 1/2006 Boast ..... F01N 1/003 181/232

(Continued)

FOREIGN PATENT DOCUMENTS

JP 2005-352188 A 12/2005
JP 2006-119432 A 5/2006

(Continued)

OTHER PUBLICATIONS

International Search Report and Written Opinion in corresponding International Application No. PCT/JP2017/041662, dated Jan. 30, 2018 (9 pages).

*Primary Examiner* — Richard A Edgar
*Assistant Examiner* — Jackson N Gillenwaters
(74) *Attorney, Agent, or Firm* — Osha Bergman Watanabe & Burton LLP

(57) ABSTRACT

A silencing device includes: a flow path forming plate having a flow path forming surface for forming a wall surface of a flow path through which fluid flows; and a cavity defining portion for defining a cavity on the reverse surface side of the flow path forming plate, the reverse surface being located on the reverse side of the flow path forming surface. The flow path forming plate has formed therein a plurality of fine through-holes which are configured to provide communication between the flow path (Continued)

forming surface and the reverse surface and which has a diameter from 0.01 mm to 0.5 mm.

9 Claims, 10 Drawing Sheets

(56) References Cited

U.S. PATENT DOCUMENTS

| | | | | |
|---|---|---|---|---|
| 7,722,316 | B2 * | 5/2010 | Scarinci | F04D 29/663 415/119 |
| 8,167,537 | B1 * | 5/2012 | Plank | F01D 5/186 415/115 |
| 8,955,643 | B2 * | 2/2015 | Liu | G10K 11/172 181/292 |
| 9,255,586 | B2 * | 2/2016 | Lee | F04D 29/663 |
| 10,385,877 | B2 * | 8/2019 | Kim | F04D 29/665 |
| 2016/0376930 | A1 | 12/2016 | Hosoya et al. | |

FOREIGN PATENT DOCUMENTS

| | | | |
|---|---|---|---|
| JP | 2006119432 | A * | 5/2006 |
| JP | 2015-124721 | A | 7/2015 |

* cited by examiner

SILENCING DEVICE, ROTARY MACHINE, AND METHOD FOR MANUFACTURING SILENCING DEVICE

Priority is claimed on Japanese Patent Application No. 2016-245438, filed on Dec. 19, 2016, the content of which is incorporated herein by reference.

TECHNICAL FIELD

The present invention relates to a silencing device, a rotary machine, and a method for manufacturing a silencing device.

BACKGROUND ART

A centrifugal compressor that compresses a gas (fluid) is widely known as a rotary machine. In this centrifugal compressor, an impeller is provided in a casing. In the centrifugal compressor, the gas suctioned from a suction port by the impeller rotating is compressed and discharged from a discharge port. In the rotary machine, it is desired to reduce the noise that is generated when the gas flows through a flow path in the casing.

A configuration in which a silencing member (resonator) is provided at a part of an inner wall surface of the flow path in the casing is disclosed in, for example, PTL 1 and PTL 2. The silencing member forms a part of the inner wall surface of the flow path. The silencing member is provided with a plurality of through-holes formed in a plate-shaped member forming a surface facing the inner side of the flow path and a member forming a space (cavity) connected to the through-hole on the back surface side that is opposite to the flow path side with respect to the plate-shaped member. The silencing member attenuates the noise that is attributable to the fluid which flows through the flow path by using the principle of the Helmholtz resonator.

CITATION LIST

Patent Literature

[PTL 1] Japanese Unexamined Patent Application, First Publication No. 2015-124721

[PTL 2] U.S. Pat. No. 6,550,574

SUMMARY OF INVENTION

Technical Problem

The noise attenuation performance of the silencing member using the principle of the Helmholtz resonator is affected by the inner diameter (cross-sectional area) of the through-hole and the volume of the space connected to the through-hole. Accordingly, a silencing device with a large through-hole inner diameter requires a space of at least, for example, tens of millimeters in order to ensure a volume required for the back surface side of the plate-shaped member. Meanwhile, the flow path in the casing of the centrifugal compressor requires, for example, a predetermined wall thickness or more in order to ensure strength after a plurality of the impellers are disposed. Accordingly, sites where the silencing device can be installed in the casing are limited.

Actually, the silencing devices disclosed in PTL 1 and PTL 2 are also provided only at a part where the inner wall surface of the flow path is planar. However, the noise reduction performance that can be obtained is limited when the silencing device can be provided only at a part of the inner wall surface of the flow path in the casing.

The present invention provides a silencing device, a rotary machine, and a method for manufacturing a silencing device allowing a noise reduction performance to be ensured and allowing an increase in the degree of freedom in terms of installation site in a flow path through which a fluid flows.

Solution to Problem

A silencing device according to a first aspect of the present invention includes a flow path forming plate having a flow path forming surface forming a wall surface of a flow path through which a fluid flows and a cavity defining portion defining a cavity on a reverse surface side facing a side opposite to the flow path forming surface with respect to the flow path forming plate. The flow path forming plate has formed therein a plurality of fine through-holes which are configured to provide communication between the flow path forming surface and the reverse surface and which has a diameter from 0.01 mm to 0.5 mm.

By the configuration being adopted, the noise that is caused by the fluid flowing through the flow path is reduced by means of the principle of the Helmholtz resonator and with the cavity and the through-hole formed in the flow path forming plate. The pressure loss in the through-hole increases by the fine through-hole having a small diameter. Accordingly, it is difficult for the fluid that has entered the cavity from the through-hole to circulate in the cavity and it is possible to suppress a decline in noise reduction effect. Even when the volume of the cavity is small, it is possible to obtain a sufficient noise reduction effect by reducing the diameter of the through-hole. As a result, the thickness of the cavity defining portion can be reduced and the thickness of the silencing device can be reduced.

In the silencing device according to a second aspect of the present invention, in the first aspect, the flow path forming plate may have a plurality of microporous plates in which the through-holes are formed and the plurality of microporous plates may be stacked in a state where the through-holes formed in the plurality of microporous plates communicate with each other.

By the configuration being adopted, the flow path forming plate is formed by the plurality of microporous plates in which the through-holes are formed being stacked. Accordingly, it is possible to easily and highly precisely form the long through-hole as compared with a case where the flow path forming plate is produced by the through-hole being formed in the single microporous plate with a large plate thickness. It is possible to easily produce the thick flow path forming plate with a deep through-hole by stacking the microporous plate that can be easily produced and has a small plate thickness as described above.

In the silencing device according to a third aspect of the present invention, in the first aspect or the second aspect, the flow path forming plate may have a thickness of 0.5 mm to 5 mm.

In the silencing device according to a fourth aspect of the present invention, in any one of the first to third aspects, an opening ratio of the plurality of through-holes in the flow path forming surface may be 0.01 to 10%.

In the silencing device according to a fifth aspect of the present invention, in any one of the first to fourth aspects, the cavity defining portion may have an outer peripheral wall portion integrally provided on the reverse surface of the flow path forming plate and surrounding an outer peripheral portion of the cavity.

By the configuration being adopted, the cavity surrounded by the outer peripheral wall portion can be defined on the reverse surface side of the flow path forming plate. Accordingly, the cavity can be defined irrespective of the shape of a casing.

In the silencing device according to a sixth aspect of the present invention, in the fifth aspect, the outer peripheral wall portion may be formed by a plurality of plate-shaped outer peripheral plate members surrounding the outer peripheral portion of the cavity being stacked in a direction orthogonal to the flow path forming surface.

By the configuration being adopted, it is possible to form the outer peripheral wall portion as well by stacking the plurality of plate-shaped outer peripheral plate members.

A rotary machine according to a seventh aspect of the present invention includes the silencing device according to any one of the first to sixth aspects in at least a part of a wall surface of a flow path through which a fluid flows.

By the configuration being adopted, the through-hole has a small diameter, and thus a decline in noise reduction effect attributable to circulation can be suppressed. In addition, since the through-hole has a small diameter, the volume of the cavity can be reduced and the thickness of the silencing device as a whole can be reduced.

A method for manufacturing a silencing device according to an eighth aspect of the present invention is a method for manufacturing a silencing device provided on a wall surface of a flow path through which a fluid flows in a rotary machine. The method includes a step of preparing a plate member having a flow path forming surface forming the wall surface, a step of forming a flow path forming plate by forming a plurality of fine through-holes with a diameter of 0.01 mm to 0.5 mm by etching in the plate member, and a step of forming a cavity defining portion defining a cavity on a reverse surface side of the flow path forming plate, the reverse surface being located on a reverse side of the flow path forming surface.

By the configuration being adopted, the fine through-hole can be formed by etching. The plurality of fine through-holes can be formed with high precision by etching. A decline in noise reduction effect attributable to fluid circulation can be limited by the highly precise fine through-holes.

The method for manufacturing a silencing device according to a ninth aspect of the present invention in the eighth aspect may further include a step of stacking a plurality of the plate members in which the plurality of through-holes are formed in a plurality of sheets in a state where the through-holes communicate with each other.

By the configuration being adopted, the microporous plate is produced by the through-hole being formed by etching in the plate member having a small plate thickness. Accordingly, the highly precise fine through-holes can be formed with ease. It is possible to easily and highly precisely produce the flow path forming plate with a long through-hole by stacking the microporous plate that can be easily produced and has a small plate thickness as described above.

In the method for manufacturing a silencing device according to a tenth aspect of the present invention, in the eighth aspect or the ninth aspect, the cavity may be defined by a plurality of plate-shaped outer peripheral plate members being stacked with respect to the flow path forming plate in the step of forming the cavity defining portion.

By the configuration being adopted, a cavity of any shape, such as a curved cavity, can be easily formed in accordance with a space.

Advantageous Effects of Invention

With the present invention, it is possible to ensure a noise reduction performance and enhance the degree of freedom in terms of installation site in a flow path through which a fluid flows.

DESCRIPTION OF EMBODIMENTS

Hereinafter, embodiments of a silencing device, a rotary machine, and a method for manufacturing a silencing device according to the present invention will be described with reference to accompanying drawings. However, the present invention is not limited to the embodiments.

First Embodiment

Figure 1:
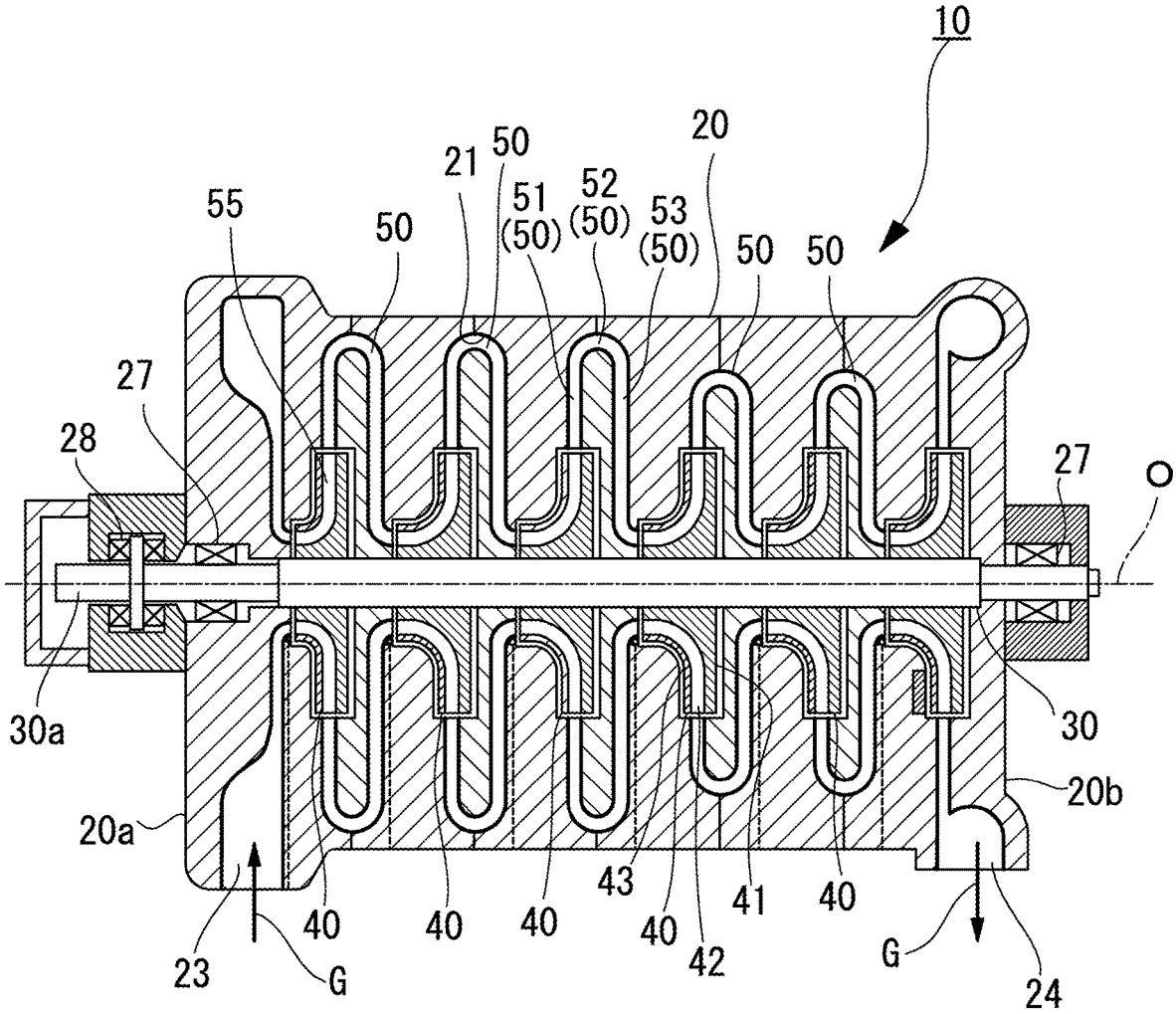
FIG. 1 is a cross-sectional view showing the configuration of a centrifugal compressor as an example of a rotary machine according to the present embodiment.
Figure 2:
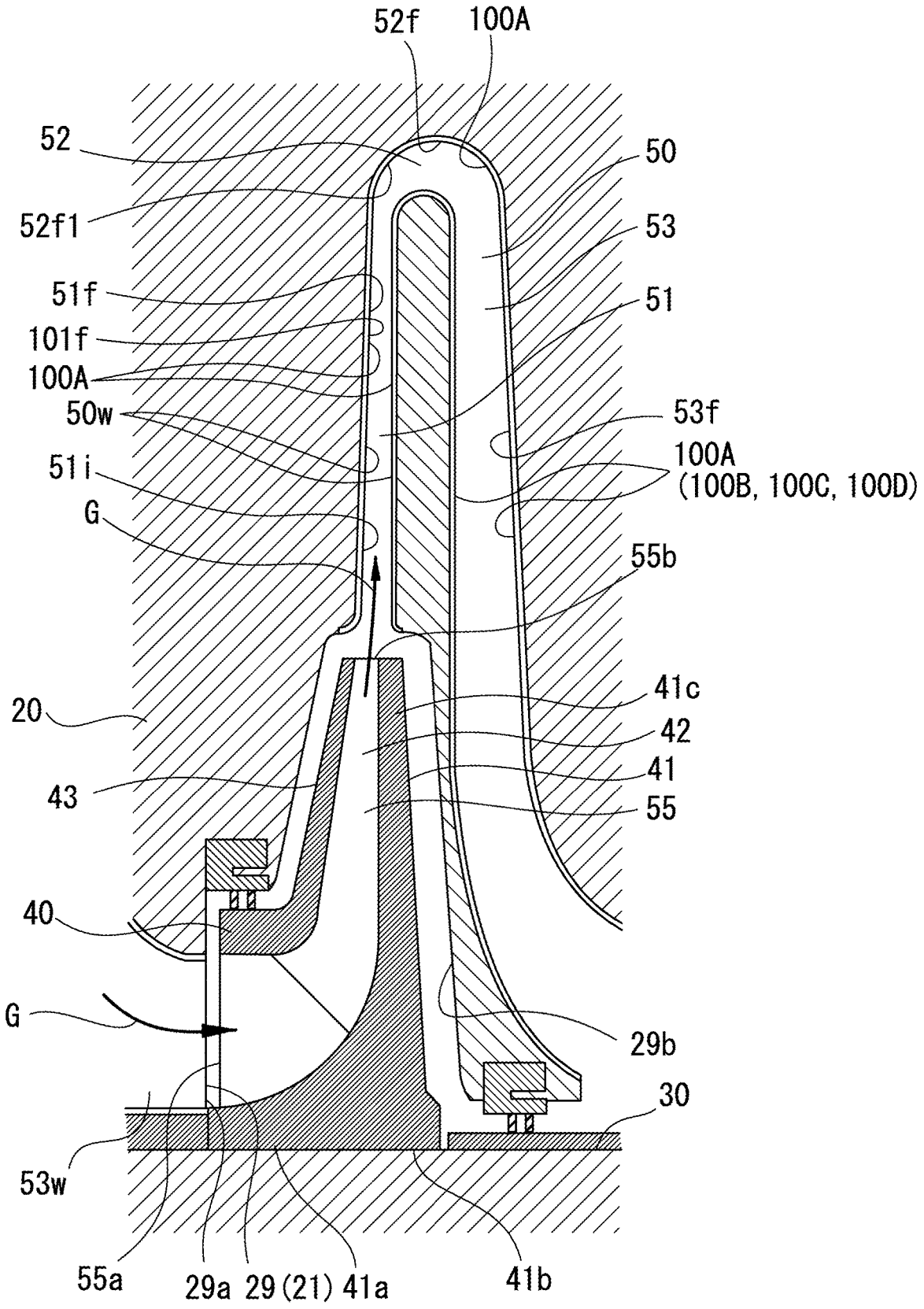
FIG. 2 is an enlarged cross-sectional view showing a main part of the centrifugal compressor.

FIG. 1 is a cross-sectional view showing the configuration of a centrifugal compressor as an example of the rotary machine in the present embodiment. FIG. 2 is an enlarged cross-sectional view showing a main part of the centrifugal compressor. As shown in FIG. 1, a centrifugal compressor (rotary machine) 10 of the present embodiment mainly includes a casing 20, a rotary shaft 30, and impellers 40. The rotary shaft 30 is supported so as to be rotatable around a central axis O in the casing 20. The impellers 40 are attached to the rotary shaft 30 and compress a gas (fluid) G by using a centrifugal force.

The casing 20 is provided with an inner space 21, and the diameter of the inner space 21 repeatedly increases and decreases. The impellers 40 are accommodated in the inner space 21. When the impellers 40 are accommodated, casing side flow paths (flow paths) 50 are formed at positions between the impellers 40 to allow the gas G flowing through the impellers 40 to flow from an upstream side to a downstream side.

A suction port 23 is provided in one end portion 20*a* of the casing 20. The suction port 23 allows the gas G to flow into the casing side flow path 50 from the outside. A discharge port 24 is provided in the other end portion 20*b* of the casing 20. The discharge port 24 is continuous with the casing side flow path 50 and allows the gas G to flow to the outside.

A journal bearing 27 and a thrust bearing 28 supporting the end portions of the rotary shaft 30 are provided on the one end portion 20*a* side of the casing 20 and the other end portion 20*b* side of the casing 20, respectively. The journal bearing 27 is provided in each of the one end portion 20*a* and the other end portion 20*b* of the casing 20. The rotary shaft 30 is supported so as to be rotatable around the central axis O via the journal bearing 27. The thrust bearing 28 is provided in the one end portion 20*a* of the casing 20. On one end side 30*a* of the rotary shaft 30, a thrust force in the central axis O direction in which the rotary shaft 30 extends is supported by the thrust bearing 28.

The plurality of impellers 40 are accommodated in the casing 20 and spaced apart from one another in the direction of the central axis O of the rotary shaft 30. It should be noted that an example of a case where six impellers 40 are provided is shown in FIG. 1. However, it is sufficient if at least one impeller 40 is provided.

As shown in FIG. 2, in the inner space 21 of the casing 20, recesses 29*a* and 29*b* for accommodating the impeller 40 are formed between the one end portion 20*a* side (left side of the page in FIG. 2) and the other end portion 20*b* side (right side of the page in FIG. 2) in the central axis O direction. An impeller accommodating portion 29 is formed in the casing 20 by the recesses 29*a* and 29*b*. The impeller accommodating portion 29 accommodates the impeller 40, and the cross-sectional shape of the impeller 40 that is orthogonal to the central axis O is circular.

In the present embodiment, the impeller 40 of the centrifugal compressor 10 is a so-called closed impeller provided with a disk portion 41, a blade portion 42, and a cover portion 43.

The middle portion of the disk portion 41 is a substantially cylindrical tubular portion 41*a* having a certain length in the central axis O direction. The inner peripheral surface of an insertion hole 41*b* of the tubular portion 41*a* is fixed to the outer peripheral surface of the rotary shaft 30. A disk-shaped disk main body portion 41*c* is integrally formed on the outer peripheral side of the tubular portion 41*a*.

A plurality of the blade portions 42 are circumferentially spaced apart from one another. Each of the blade portions 42 is integrally formed so as to protrude from the disk portion 41 toward the cover portion 43 side, which is the one end portion 20*a* side of the casing 20. The cover portion 43 has a disk shape and is formed so as to cover the plurality of blade portions 42.

The casing side flow path 50 has a diffuser flow path 51, a return flow path 52, and a return flow path 53.

The diffuser flow path 51 allows a fluid discharged from the impeller 40 to flow. The diffuser flow path 51 is formed so as to extend radially outward from the outer peripheral side of each impeller 40.

The return flow path 52 inverts the flow direction of the fluid that has flowed through the diffuser flow path 51 by 180 degrees. The return flow path 52 is formed so as to be continuous with the outer side in the radial direction of the diffuser flow path 51. The return flow path 52 is formed so as to turn in a U shape in cross section and extend radially inward from the outer side in the radial direction of the diffuser flow path 51 toward the other end portion 20*b* side of the casing 20.

The return flow path 53 introduces the fluid that has flowed through the return flow path 52 into the impeller 40. The return flow path 53 is formed radially inward from the return flow path 52. The return flow path 53 has a curved portion 53*w*, which is curved toward the impeller 40 of the next stage, in the radially inner end portion of the return flow path 53.

In each impeller 40, an impeller side flow path 55 is formed between the disk portion 41 and the cover portion 43. The impeller side flow path 55 is a flow path defined by the disk portion 41, the blade portion 42, and the cover portion 43. In each impeller 40, an end portion 55*a* of the impeller side flow path 55, which faces the one end portion 20*a* side in the central axis O direction, faces the curved portion 53*w* of the return flow path 53. In the impeller side flow path 55, an end portion 55*b*, which is on the side that is opposite to the end portion 55*a*, is formed so as to face the diffuser flow path 51 toward the radially outer side.

As shown in FIGS. 1 and 2, in the centrifugal compressor 10, the gas G is introduced from the suction port 23 to the casing side flow path 50. Subsequently, the gas G flows into the impeller side flow path 55 from the end portion 55*a* in close proximity to the radially inner side of the blade portion 42 with respect to the impeller 40 rotating around the central axis O with the rotary shaft 30. The gas G that has flowed into the impeller side flow path 55 flows out toward the radially outer side from the end portion 55*b* in close proximity to the radially outer side of the blade portion 42. Between the blade portions 42 that are circumferentially adjacent to each other is a compression flow path through which gas G radially flows. The gas G is compressed by passing through the impeller side flow path 55.

The gas G that has flowed out from the impeller 40 of each stage flows radially outward through the diffuser flow path 51 of the casing side flow path 50. Subsequently, the gas G turns through the return flow path 52 such that the flow direction of the gas G is changed by 180 degrees and is sent to the impeller 40 on the latter stage side through the return flow path 53. In this manner, the gas G is compressed in multiple stages by passing through the impeller side flow paths 55 and the casing side flow paths 50 of the impellers 40 provided in multiple stages from the one end portion 20*a* side of the casing 20 to the other end portion 20*b* side of the casing 20. Subsequently, the gas G is sent out from the discharge port 24.

The centrifugal compressor 10 is provided with a silencing device 100A.

Figure 3:
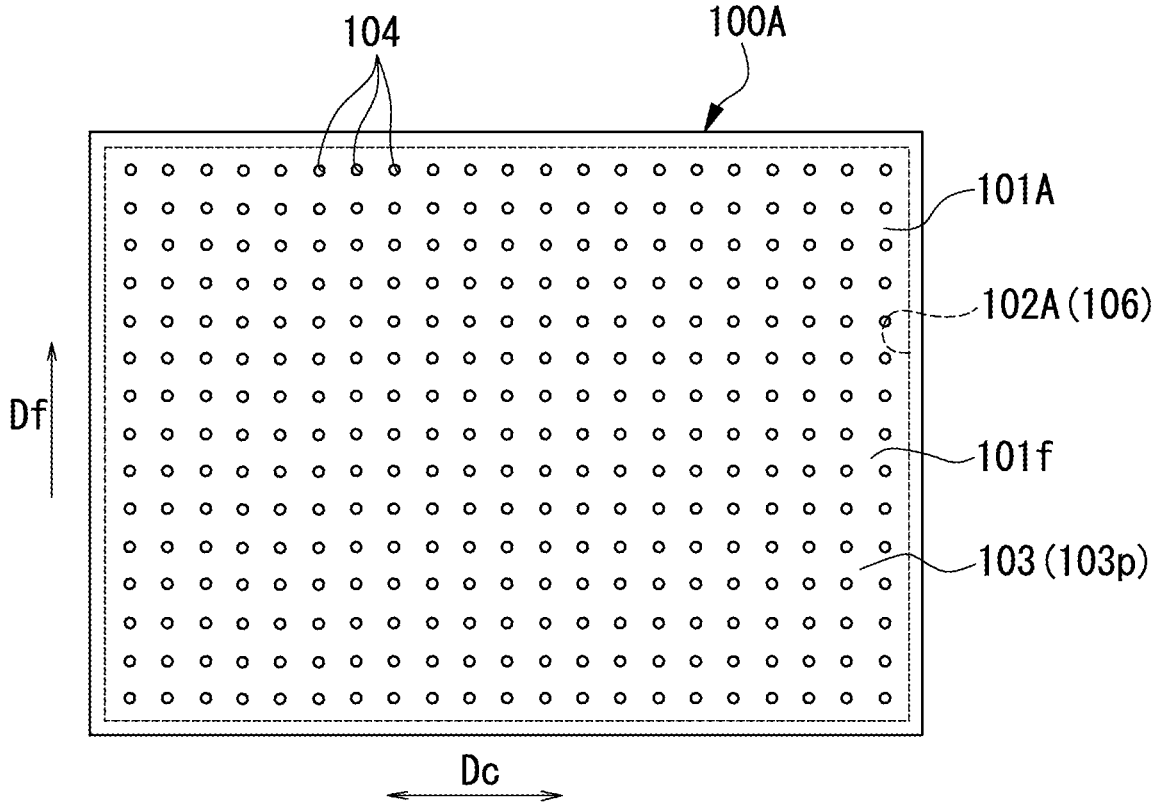
FIG. 3 is a diagram in which a silencing device that is provided in the centrifugal compressor according to the first embodiment is seen from the inside of a flow path.
Figure 4:
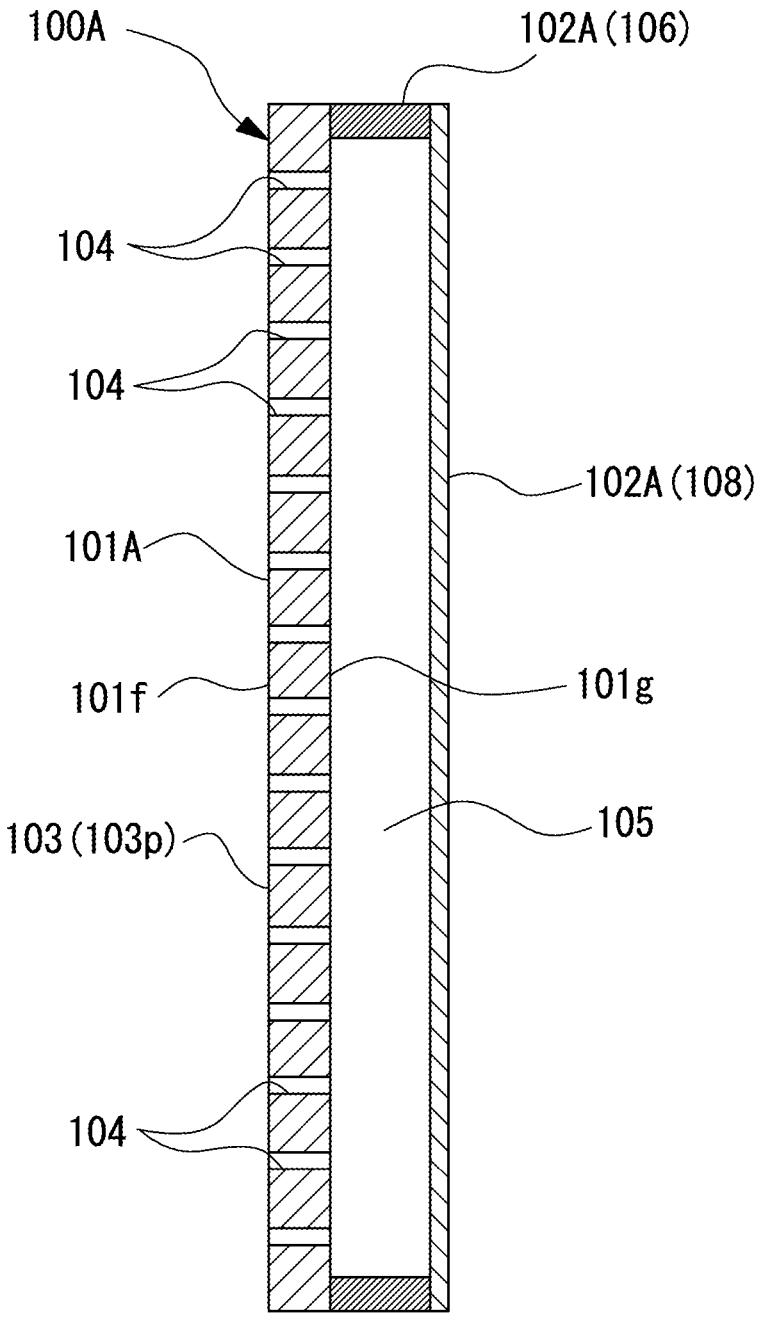
FIG. 4 is a diagram showing a cross-sectional structure of the silencing device.

FIG. 3 is a diagram in which the silencing device that is provided in the centrifugal compressor is seen from the inside of a flow path. FIG. 4 is a diagram showing a cross-sectional structure of the silencing device. As shown in FIGS. 3 and 4, the silencing device 100A is integrally provided with a flow path forming plate 101A and a cavity defining portion 102A.

As shown in FIGS. 2 to 4, the flow path forming plate 101A has a flow path forming surface 101*f* forming a wall surface 50*w* of the casing side flow path 50 through which the gas G flows. The flow path forming plate 101A has a plurality of fine through-holes 104 providing communication between the flow path forming surface 101*f* and a reverse surface 101*g* facing the opposite side. The plurality of through-holes 104 are evenly spaced apart from one another with respect to a flow direction Df in the casing side flow path 50 and a circumferential direction Dc, which is a direction crossing the flow direction Df and the direction in which the rotary shaft 30 rotates. The flow path forming plate 101A of the present embodiment is constituted only by a single metallic microporous plate 103 in which multiple through-holes 104 are formed.

Here, the through-hole 104 has a diameter of 0.01 mm to 0.5 mm More preferably, the diameter of the through-hole 104 ranges from 0.05 to 0.1 mm. The thickness of the flow path forming plate 101A is preferably 0.1 mm to 20 mm. More preferably, the thickness of the flow path forming plate 101A ranges from 0.2 mm to 6 mm. The opening ratio of the plurality of through-holes 104 in the flow path forming surface 101*f* is preferably 0.01 to 10%. More preferably, the opening ratio of the through-holes 104 ranges from 0.5% to 10%. It should be noted that the opening ratio is the opening area of the through-hole 104 per unit volume of a cavity 105, which will be described later.

The cavity defining portion 102A is provided on the reverse surface 101*g* side of the flow path forming plate 101A, the reverse surface 101*g* being located on the reverse side of the flow path forming surface 101*f*. The cavity defining portion 102A is integrally fixed to the reverse surface 101*g* of the flow path forming plate 101A. The cavity defining portion 102A defines the cavity 105 on the reverse surface 101*g* side of the flow path forming plate 101A. The cavity defining portion 102A of the present embodiment has an outer peripheral wall portion 106 and a back plate 108.

The outer peripheral wall portion 106 is continuous along the outer peripheral portion of the flow path forming plate 101A. The outer peripheral wall portion 106 of the present embodiment is a plate-shaped member that extends so as to protrude from the reverse surface 101*g*.

The back plate 108 blocks the space that is surrounded by the outer peripheral wall portion 106 with the flow path forming plate 101A. The back plate 108 is disposed on the side that is opposite to the flow path forming plate 101A with respect to the outer peripheral wall portion 106.

The reverse surface 101*g* of the flow path forming plate 101A, the outer peripheral wall portion 106, and the back plate 108 form a surrounded space inside the reverse surface 101*g* of the flow path forming plate 101A, the outer peripheral wall portion 106, and the back plate 108. This space is the cavity 105 communicating with the multiple through-holes 104 formed in the flow path forming plate 101A.

It is preferable that the depth of the cavity 105, which is the length of the outer peripheral wall portion 106 in the direction that is orthogonal to the flow path forming surface 101*f*, is 0.2 mm to 500 mm More preferably, the depth of the cavity 105 ranges from 1 mm to 30 mm.

As shown in FIG. 2, the silencing device 100A is provided in at least a part of the wall surface 50*w* of the casing side flow path 50 through which the gas G flows in the centrifugal compressor 10. In this embodiment, the silencing device 100A is provided in the whole of a wall surface 51*f* of the diffuser flow path 51, a wall surface 52*f* of the return flow path 52, and a wall surface 53*f* of the return flow path 53 constituting the casing side flow path 50. In other words, the silencing device 100A of the present embodiment is provided so as to cover all of the wall surfaces of the casing side flow path 50.

It should be noted that it is particularly preferable that the silencing device 100A is provided in at least a diffuser inlet portion 51*i* on the outer peripheral side of each impeller 40 in, for example, the diffuser flow path 51. This is because a sound that is generated by the impeller 40 is generated mainly in the vicinity of the end portion 55*b* of the impeller 40. Further, it is preferable that the silencing device 100A is provided on a wall surface 52*f*1 of the wall surface 52*f* of the return flow path 52, which faces the outlet of the diffuser flow path 51 and faces radially inward. This is because a sound that has been generated in the end portion 55*b* of the impeller 40 is highly likely to be reflected by the wall surface 52*f*1 facing the radially inner side of the return flow path 52.

The silencing device 100A reduces the noise that is caused by the gas G flowing through the casing side flow path 50 by using the principle of the Helmholtz resonator and with the cavity 105 and the through-hole 104 formed in the flow path forming plate 101A.

Figure 5:
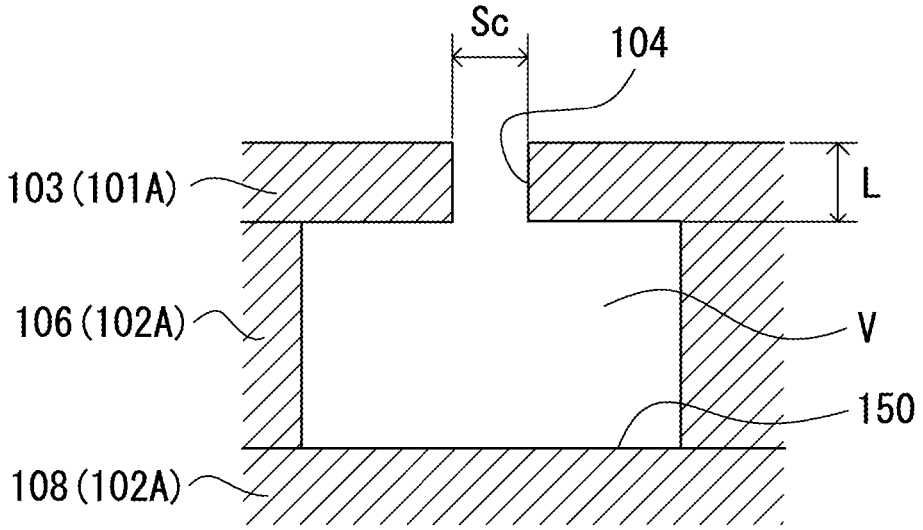
FIG. 5 is a diagram showing the dimension of each part in the principle of the Helmholtz resonator.

FIG. 5 is a diagram showing the dimension of each part in the principle of the Helmholtz resonator. Here, a resonance frequency f at which the silencing device 100A demonstrates a silencing effect can be predicted by the following equations when the opening cross-sectional area of the through-hole 104 is Sc, the length of the through-hole 104 (thickness of the flow path forming plate 101A) is L, and the volume of the cavity 105 is V as shown in FIG. 5. It should be noted that c is the speed of sound (=340,000 mm/s).

$$f = \frac{c}{2\pi}\sqrt{\frac{\mu}{V}} \quad \text{[Equation 1]}$$

$$\mu = \frac{Sc}{L + 0.8\sqrt{Sc}} \quad \text{[Equation 2]}$$

According to the above equations, in a case where the cavity 105 has a volume V of 2,500 $mm^3$ and the thickness of the flow path forming plate 101A is 1 mm, for example, the diameter of the through-hole 104 is preferably 0.2 mm and the number of the through-holes 104 is 10 at a target frequency of 500 Hz.

In a case where the target frequency is 2 kHz and the volume V of the cavity 105 and the thickness of the flow path forming plate 101A are the same as above, it is preferable that the diameter of the through-hole is 0.2 mm and the number of the through-holes 104 is 40.

A method for manufacturing the silencing device 100A described above will be described below.

Figure 6:
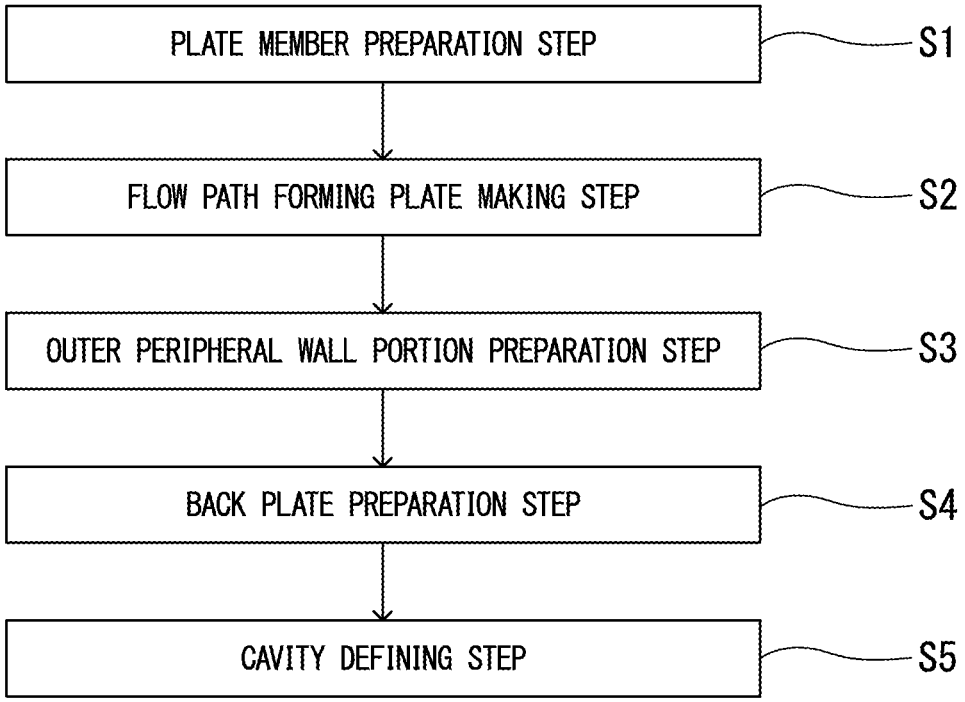
FIG. 6 is a flow diagram showing each step of a method for manufacturing the silencing device of the first embodiment.

FIG. 6 is a flow diagram showing each step of the method for manufacturing the silencing device of the first embodiment. The method for manufacturing the silencing device of the present embodiment is a manufacturing method for manufacturing the silencing device 100A provided on the wall surface 50*w* of the casing side flow path 50 in the centrifugal compressor. As shown in FIG. 6, the method for manufacturing the silencing device of the first embodiment includes a plate member preparation step S1, a flow path forming plate making step S2, an outer peripheral wall portion preparation step S3, a back plate preparation step S4, and a cavity defining step S5.

A plate member 103*p* is prepared in the plate member preparation step S1. The plate member 103*p* has the flow path forming surface 101*f* forming the wall surface 50*w*. In other words, the plate member 103*p* is the flow path forming plate 101A where the through-hole 104 is yet to be formed. Specifically, in the plate member preparation step S1 of the present embodiment, the plate member 103*p* is formed by, for example, a member being cut out in a plate shape from a metal plate.

In the flow path forming plate making step S2, the flow path forming plate 101A is made by the plurality of fine through-holes 104 with a diameter of 0.01 mm to 0.5 mm being formed in the plate member 103*p* by etching. In the flow path forming plate making step S2 of the present embodiment, the flow path forming plate 101A is made as one microporous plate 103.

The outer peripheral wall portion 106 is prepared in the outer peripheral wall portion preparation step S3. Specifically, in the outer peripheral wall portion preparation step S3 of the present embodiment, the outer peripheral wall portion 106 is formed by, for example, a hollow annular member being cut out from a metal plate.

The back plate 108 is prepared in the back plate preparation step S4. Specifically, in the back plate preparation step S4 of the present embodiment, the back plate 108 is formed by, for example, a member being cut out in a plate shape from a metal plate.

The cavity 105 is defined by the flow path forming plate 101A, the outer peripheral wall portion 106, and the back plate 108 in the cavity defining step S5. In the cavity defining step S5 of the present embodiment, the outer peripheral wall portion 106 and the back plate 108 are stacked with respect to the reverse surface 101*g* of the flow path forming plate 101A and the reverse surface 101*g*, the outer peripheral wall portion 106, and the back plate 108 are integrally joined by, for example, room-temperature high-pressure crimping. The silencing device 100A is manufactured as a result.

It should be noted that the cavity defining portion 102A may be joined to the flow path forming plate 101A after the cavity defining portion 102A is made in advance by joining of the outer peripheral wall portion 106 and the back plate 108 in the cavity defining step S5.

With the silencing device 100A and the centrifugal compressor 10 described above, it is possible to reduce the noise that is caused by the gas G flowing through the casing side flow path 50 by using the principle of the Helmholtz resonator and with the cavity 105 and the through-hole 104 formed in the flow path forming plate 101A. Since the diameter of the through-hole 104 is as small as 0.01 mm to 0.5 mm, the pressure loss becomes larger than that of a through-hole in the case of machining-based formation in the through-hole 104. Accordingly, it is difficult for the gas G that has entered the cavity 105 from the through-hole 104 to circulate in the cavity 105 and it is possible to limit a decline in noise reduction effect.

Even when the volume of the cavity 105 is small, it is possible to obtain a sufficient noise reduction effect by reducing the diameter of the through-hole 104. As a result, the thickness of the cavity defining portion 102A can be reduced and the thickness of the silencing device 100A as a whole can be reduced. Accordingly, it is possible to ensure a noise reduction performance and enhance the degree of freedom in terms of installation site in the casing side flow path 50 for the gas G.

It is possible to easily and highly precisely form the fine through-holes 104 by producing the through-holes 104 by etching. Accordingly, it is possible to reliably and usefully make the plurality of fine through-holes 104 having a diameter of 0.01 mm to 0.5 mm, which are not easily made with high precision by machining.

The outer peripheral wall portion 106 is provided as the cavity defining portion 102A. Accordingly, it is possible to define the cavity 105 having a certain depth ensured by the outer peripheral wall portion 106 on the reverse surface 101*g* side of the flow path forming plate 101A. As a result, the cavity can be defined irrespective of the shape of the casing.

Modification Example of First Embodiment

It should be noted that the silencing device is not limited to the above-described configuration of the first embodiment in which one cavity 105 is provided on the reverse surface 101*g* side of the flow path forming plate 101A where the multiple through-holes 104 are formed.

Figure 7:
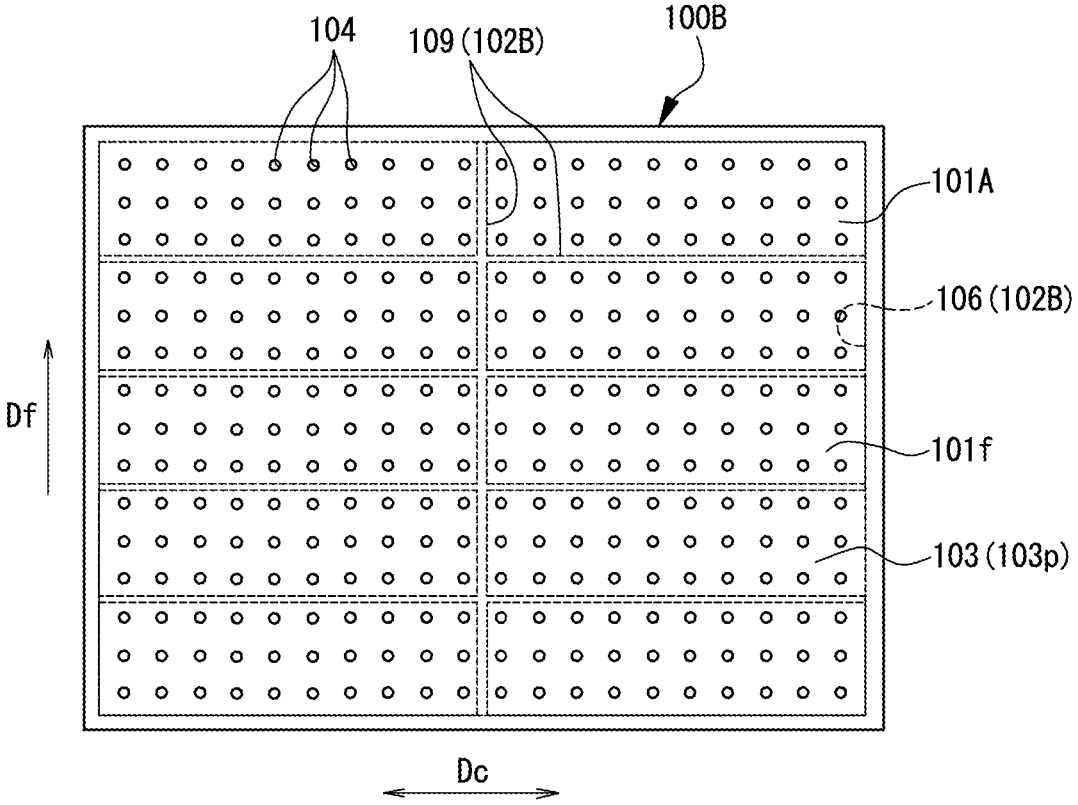
FIG. 7 is a diagram in which a modification example of the silencing device provided in the centrifugal compressor is seen from the inside of a flow path.
Figure 8:
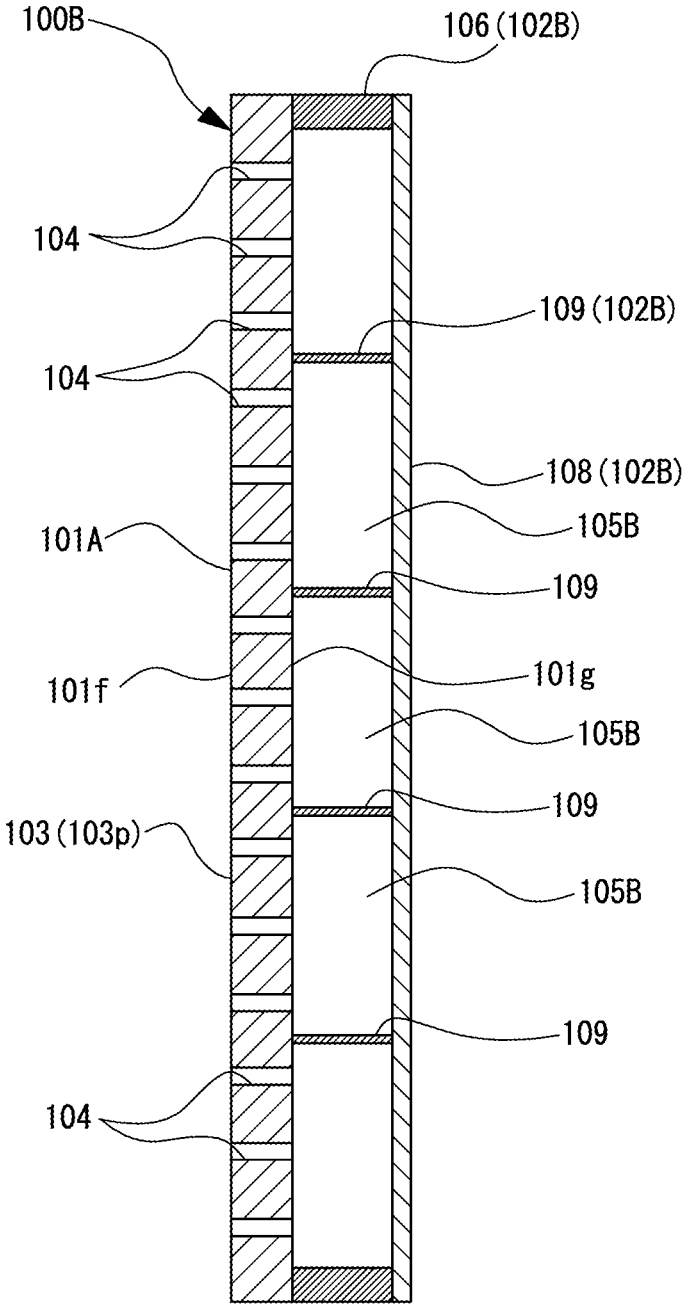
FIG. 8 is a diagram showing a cross-sectional structure of the modification example of the silencing device.

FIG. 7 is a diagram in which a modification example of the silencing device provided in the centrifugal compressor is seen from the inside of a flow path. FIG. 8 is a diagram showing a cross-sectional structure of the modification example of the silencing device.

As shown in FIGS. 7 and 8, a silencing device 100B of the modification example of the first embodiment is provided with a partition wall 109 that partitions the cavity 105 into a plurality of parts on the reverse surface 101*g* side of the flow path forming plate 101A. The partition wall 109 of the present embodiment is a plate-shaped member. A plurality of small cavities 105B are defined on the reverse surface 101*g* side of the flow path forming plate 101A by the partition wall 109.

Here, it is preferable that each small cavity 105B is given different dimensions in the flow direction Df in the casing side flow path 50 and the circumferential direction Dc crossing the flow direction Df in accordance with the static pressure distribution in the casing side flow path 50. For example, it is preferable that the dimension of the small cavity 105B in the circumferential direction Dc is longer than the dimension of the small cavity 105B in the flow direction Df, which is more prone to the static pressure distribution. Specifically, it is preferable that the partition wall 109 is provided such that the dimension of the small cavity 105B in the circumferential direction Dc is approximately two to 10 times the dimension of the small cavity 105B in the flow direction Df.

Then, it is possible to effectively prevent the gas G that has flowed into each small cavity 105B through the through-hole 104 from flowing so as to circulate in the small cavity 105B.

Second Embodiment

Next, a second embodiment of the silencing device according to the present invention will be described. It should be noted that the second embodiment to be described below is different in silencing device configuration from the first embodiment and the same reference numerals are given in the drawings to the configurations that are common with the first embodiment, such as the overall configuration of the centrifugal compressor 10, so that the same description does not have to be repeated.

Figure 9:
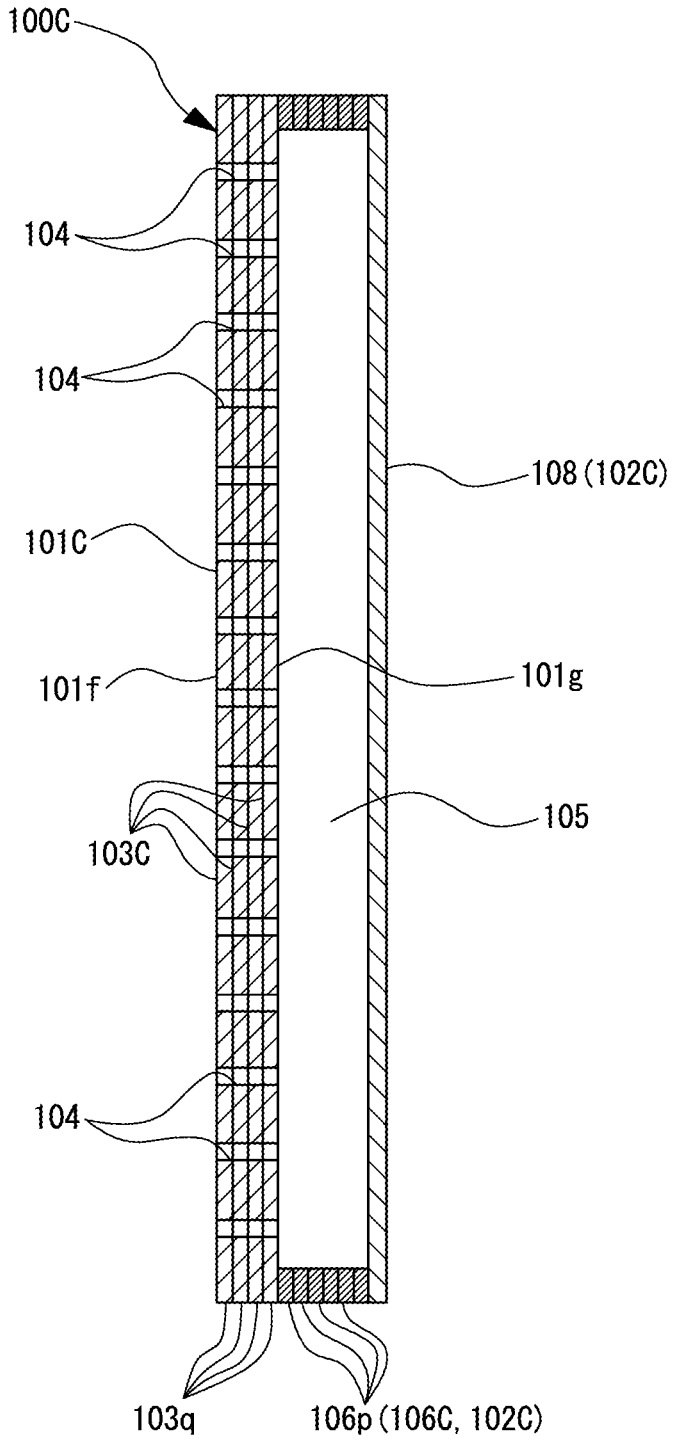
FIG. 9 is a diagram showing a cross-sectional structure of a silencing device according to a second embodiment of the silencing device.

FIG. 9 is a diagram showing a cross-sectional structure of the silencing device according to the second embodiment of the silencing device.

As shown in FIG. 9, a silencing device 100C is provided with a flow path forming plate 101C and a cavity defining portion 102C.

The flow path forming plate 101C has the flow path forming surface 101*f* forming the wall surface 50*w* of the casing side flow path 50 through which the gas G flows. The flow path forming plate 101C of the second embodiment is configured by a plurality of microporous plates 103C being stacked, and the microporous plate 103C is smaller in plate thickness than the microporous plate 103 of the first embodiment. The plurality of microporous plates 103C have the same thickness as the microporous plate 103 by being overlapped. Specifically, in a case where the microporous plate 103 has a thickness of 1 mm, the thickness of the microporous plate 103C is approximately 0.2 mm. In the flow path forming plate 101C, the through-holes 104 formed in the plurality of microporous plates 103C communicate with each other. Accordingly, the plurality of microporous plates 103C constitute the flow path forming plate 101C by stacking in a state where the plurality of through-holes 104 communicate with each other. The plurality of through-holes 104 provide communication between the respective flow path forming plates 101C in the plate thickness direction.

The plurality of through-holes 104 have a diameter of 0.01 mm to 0.5 mm in a state where the plurality of through-holes 104 communicate with each other.

The cavity defining portion 102C is formed on the reverse surface 101*g* side of the flow path forming plate 101C, the reverse surface 101*g* being located on the reverse side of the flow path forming surface 101*f*. The cavity defining portion 102C of the second embodiment includes the back plate 108 and an outer peripheral wall portion 106C surrounding the outer peripheral portion of the cavity 105. Here, the outer peripheral wall portion 106C of the second embodiment is formed by a plurality of plate-shaped outer peripheral plate members 106*p*, which surround the outer peripheral portion of the cavity 105, being stacked in the direction that is orthogonal to the flow path forming surface 101*f*. The outer peripheral plate member 106*p* is a plate-shaped member in which a hole is formed inside.

Next, a method for manufacturing the silencing device 100C of the second embodiment will be described.

Figure 10:
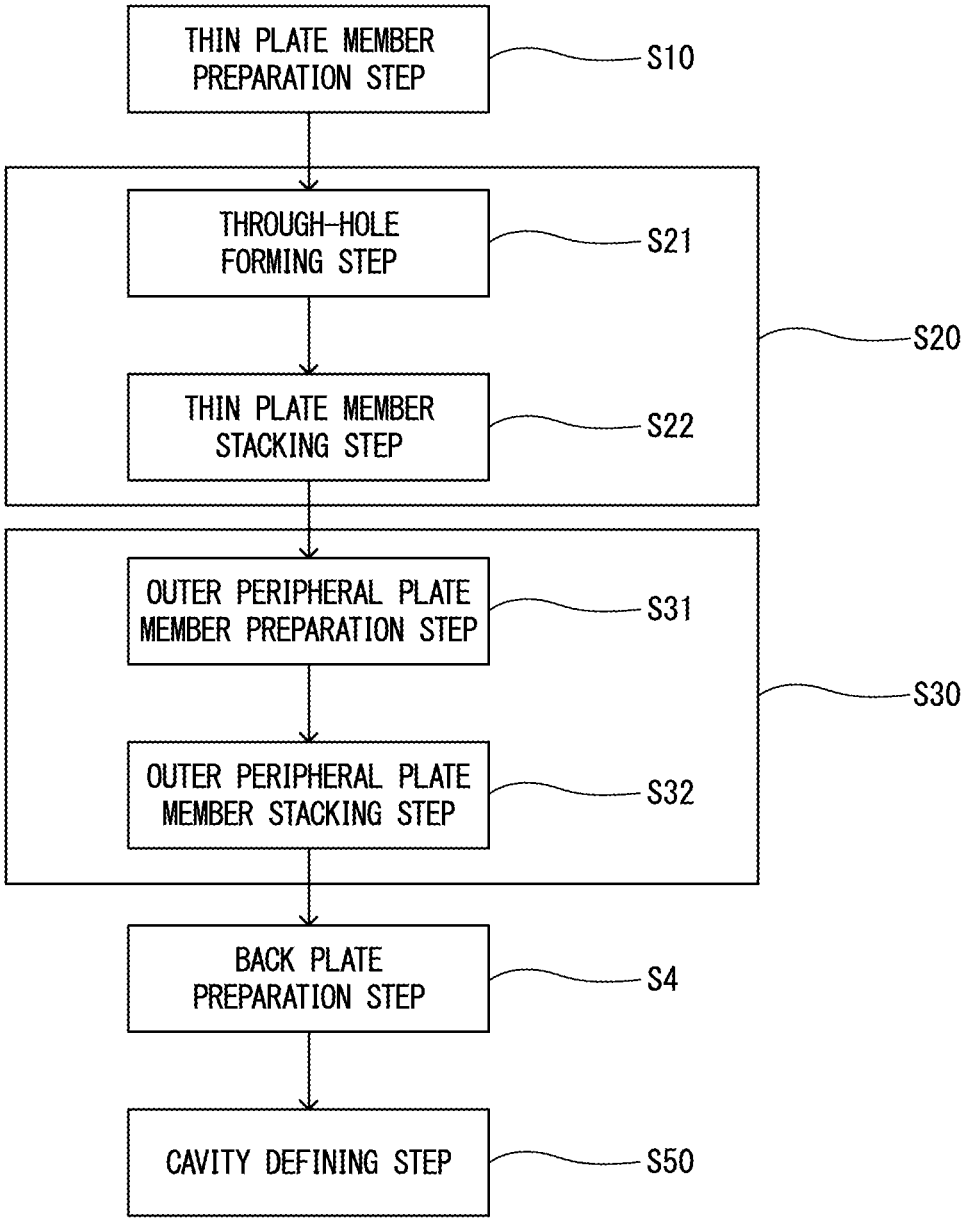
FIG. 10 is a flow diagram showing each step of a method for manufacturing the silencing device of the second embodiment.

FIG. 10 is a flow diagram showing each step of the method for manufacturing the silencing device of the second embodiment. The method for manufacturing the silencing device of the second embodiment includes a thin plate member preparation step S10, a flow path forming plate making step S20, an outer peripheral wall portion preparation step S30, the back plate preparation step S4, and a cavity defining step S50 as shown in FIG. 10.

A thin plate member 103*q* is prepared in the thin plate member preparation step S10. The thin plate member 103*q* has a shape along the wall surface 50*w*. A plurality of the thin plate members 103*q* are members corresponding in thickness to the plate member 103*p* of the first embodiment by being overlapped. Specifically, in the thin plate member preparation step S10 of the present embodiment, the thin plate member 103*q* is formed by, for example, a member being cut out in a plate shape from a metal plate.

In the flow path forming plate making step S20, the flow path forming plate 101C is obtained from the thin plate member 103*q*. The flow path forming plate making step S20 of the present embodiment includes a through-hole forming step S21 and a thin plate member stacking step S22.

In the through-hole forming step S21, the plurality of fine through-holes 104 with a diameter of 0.01 mm to 0.5 mm are formed in the thin plate member 103*q* by etching. As a result, the plurality of microporous plates 103C are formed in the through-hole forming step S21 of the present embodiment.

In the thin plate member stacking step S22, the plurality of thin plate members 103*q* (microporous plates 103C) in which the plurality of through-holes 104 are formed are stacked and the thin plate members 103*q* are integrally joined by, for example, room-temperature high-pressure crimping. The flow path forming plate 101C in which the plurality of microporous plates 103C are stacked is made as a result.

The outer peripheral wall portion 106C is prepared in the outer peripheral wall portion preparation step S30. Specifically, the outer peripheral wall portion preparation step S30 of the present embodiment includes an outer peripheral plate member preparation step S31 and an outer peripheral plate member stacking step S32.

The outer peripheral plate member 106*p* is prepared in the outer peripheral plate member preparation step S31. Specifically, in the outer peripheral plate member preparation step S31 of the present embodiment, the outer peripheral plate member 106*p* is formed by, for example, a hollow annular member being cut out from a metal plate.

In the outer peripheral plate member stacking step S32, the plurality of outer peripheral plate members 106*p* are stacked in a plurality of sheets and the outer peripheral plate members 106*p* are integrally joined by, for example, room-temperature high-pressure crimping. The outer peripheral wall portion 106C in which the plurality of outer peripheral plate members 106*p* are stacked is made as a result.

In the back plate preparation step S4, the back plate 108 is prepared by the same method as in the first embodiment.

The cavity 105 is defined by the flow path forming plate 101C, the outer peripheral wall portion 106C, and the back plate 108 in the in the cavity defining step S50. In the cavity defining step S50 of the present embodiment, the outer peripheral wall portion 106C and the back plate 108 are stacked with respect to the reverse surface 101*g* of the flow path forming plate 101C and the reverse surface 101*g*, the outer peripheral wall portion 106C, and the back plate 108 are integrally joined by, for example, room-temperature high-pressure crimping. The silencing device 100C is manufactured as a result.

It should be noted that the outer peripheral plate member preparation step S31 and the outer peripheral plate member stacking step S32 may be omitted in the method for manufacturing the silencing device of the second embodiment. In this case, the cavity 105 may be defined by the plurality of microporous plates 103C, the plurality of outer peripheral plate members 106*p*, and the back plate 108 being collectively and integrally joined by the cavity defining step S50 in the method for manufacturing the silencing device of the second embodiment.

With the silencing device 100C described above, it is possible to easily and highly precisely form the long through-holes 104 and achieve actions and effects similar to those of the first embodiment at the same time. Specifically, in the second embodiment, the microporous plate 103C is produced by the through-hole 104 being formed by etching in the thin plate member 103*q* with a small plate thickness instead of the microporous plate 103 being produced by the through-hole 104 being formed in the single plate member 103*p* with a large plate thickness. Accordingly, it is possible to easily and highly precisely form the long through-hole 104 as compared with a case where the flow path forming plate 101A is produced by the through-hole 104 being formed in the single microporous plate 103 with a large plate thickness. It is possible to easily produce the flow path forming plate 101C having the long through-hole 104 by stacking the microporous plate 103C that can be easily produced and has a small plate thickness as described above.

By stacking the plurality of microporous plate 103C in which the through-holes 104 are formed, it is possible to form the through-holes 104 in a shape other than the shape that is orthogonal to the flow path forming surface 101*f*. For example, it is possible to form the through-hole 104 that is inclined or curved with respect to the flow path forming surface 101*f*, and it is possible to effectively suppress a circulatory flow of the gas G in the cavity 105. Accordingly, it is possible to enhance the noise reduction effect and hinder circulation by increasing the pressure loss in the through-hole 104.

The outer peripheral wall portion 106C is formed by the plurality of plate-shaped outer peripheral plate members

106*p*, which surround the outer peripheral portion of the cavity 105, being stacked in the direction that is orthogonal to the flow path forming surface 101*f*. As a result, it is possible to easily produce the outer peripheral wall portion 106C by etching as in the case of the flow path forming plate 101C. The formation can be performed by the plurality of plate-shaped outer peripheral plate members 106*p* being stacked.

By forming the flow path forming plate 101C and the outer peripheral wall portion 106C by stacking a plurality of members, it is possible to install the silencing device 100C having a shape corresponding to the shape of the curved casing side flow path 50.

By providing the silencing device 100C in the diffuser flow path 51 in particular, it is possible to effectively reduce noise in a place where sound is likely to be held in the vicinity of the end portion 55*b* of the impeller side flow path 55 of the impeller 40.

Although embodiments of the present invention have been described in detail with reference to the drawings, the respective configurations of the embodiments, combinations of the configurations, and so on are merely examples and additions, omissions, substitutions, and other changes in configuration are possible without departing from the spirit of the present invention. The present invention is not limited by the embodiments. The present invention is limited only by the claims.

For example, the back plate 108 may be omitted and the cavity 105 may be blocked by the casing 20 although the silencing devices 100A to 100C are provided with the back plate 108 in each of the embodiments and the modification example.

Figure 11:
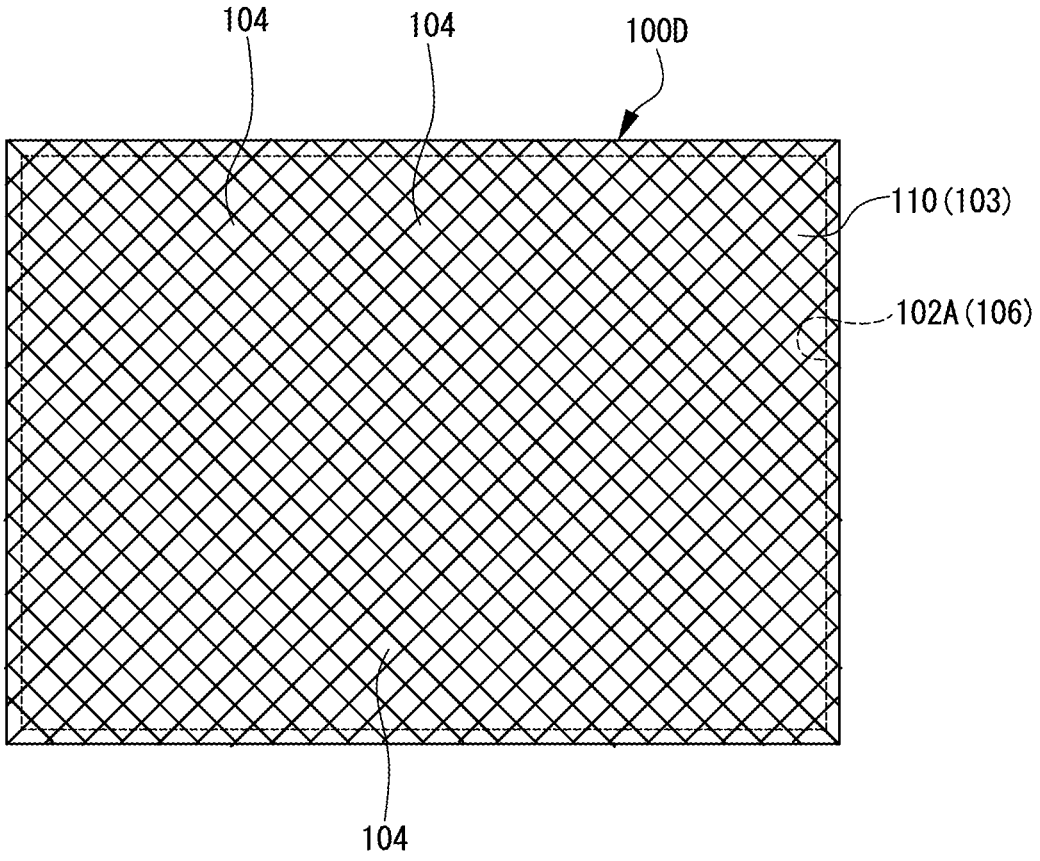
FIG. 11 is a diagram showing a modification example of the silencing device.

Although structures in which the microporous plates 103 and 103C in which the through-hole 104 is formed by etching are used as the flow path forming plates 101A and 101C have been described in the embodiments and the modification example, the flow path forming plate is not limited to the structures insofar as the plurality of fine through-holes 104 with a diameter of 0.01 mm to 0.5 mm are formed. The flow path forming plate may be constituted by a wire gauze 110 as in, for example, a silencing device 100D shown in FIG. 11. In this case, it is preferable that the wire gauze 110 is formed by plain weave or twill weave.

INDUSTRIAL APPLICABILITY

The silencing device, the rotary machine, and the method for manufacturing the silencing device described above allow a noise reduction performance to be ensured and allow an increase in the degree of freedom in terms of installation site in a flow path through which a fluid flows.

REFERENCE SIGNS LIST

10 Centrifugal compressor (rotary machine)
20 Casing
20*a* One end portion
20*b* The other end portion
21 Inner space
23 Suction port
24 Discharge port
27 Journal bearing
28 Thrust bearing
29 Impeller accommodating portion
29*a*, 29*b* Recess
30 Rotary shaft
30*a* One end side
40 Impeller
41 Disk portion
41*a* Tubular portion
41*b* Insertion hole
41*c* Disk main body portion
42 Blade portion
43 Cover portion
50 Casing side flow path
50*w* Wall surface
51 Diffuser flow path
51*f* Wall surface
51*i* Diffuser inlet portion
52 Return flow path
52*f* Wall surface
52*f*1 Wall surface
53 Return flow path
53*f* Wall surface
53*w* Curved portion
55 Impeller side flow path
55*a*, 55*b* End portion
100A, 100B, 100C, 100D Silencing device
101A, 101C Flow path forming plate
101*f* Flow path forming surface
101*g* Reverse surface
102A, 102B, 102C Cavity defining portion
103, 103C Microporous plate
103*p* Plate member
103*q* Thin plate member
104 Through-hole
105 Cavity
105B Small cavity
106 Outer peripheral wall portion
106*p* Outer peripheral plate member
108 Back plate
109 Partition wall
110 Wire gauze
G Gas (fluid)
O Central axis
S1 Plate member preparation step
S2, S20 Flow path forming plate making step
S3, S30 Outer peripheral wall portion preparation step
S4 Back plate preparation step
S5, S50 Cavity defining step
S10 Thin plate member preparation step
S21 Through-hole forming step
S22 Thin plate member stacking step
S31 Outer peripheral plate member preparation step
S32 Outer peripheral plate member stacking step

What is claimed is:

1. A silencing device comprising:

a flow path forming plate having a flow path forming surface forming a wall surface of a flow path through which a fluid flows; and a cavity defining portion defining a cavity on a reverse surface side facing a side opposite to the flow path forming surface with respect to the flow path forming plate, wherein the flow path forming plate has formed therein a plurality of fine through-holes which are configured to provide communication between the flow path forming surface and the reverse surface and which has a diameter from 0.01 mm to 0.5 mm, the flow path forming plate comprises a plurality of microporous plates in which the plurality of fine through-holes are formed, the plurality of microporous plates are integrally stacked in a state where the plurality of fine through-holes communicate with each other, the cavity defining portion has an outer peripheral wall portion integrally provided on the reverse surface of the flow path forming plate and surrounding an outer peripheral portion of the cavity, and the outer peripheral wall portion is formed by a plurality of plate-shaped outer peripheral plate members surrounding the outer peripheral portion of the cavity being stacked in a direction orthogonal to the flow path forming surface.

2. The silencing device according to claim 1, wherein the flow path forming plate has a thickness of 0.5 mm to 5 mm.

3. The silencing device according to claim 1, wherein an opening ratio of the plurality of through-holes in the flow path forming surface is 0.01 to 10%.

4. The silencing device according to claim 2, wherein an opening ratio of the plurality of through-holes in the flow path forming surface is 0.01 to 10%.

5. A rotary machine comprising the silencing device according to claim 1 in at least a part of a wall surface of a flow path through which a fluid flows.

6. The silencing device according to claim 1, wherein the flow path forming plate has a thickness of 0.5 mm to 5 mm.

7. The silencing device according to claim 6, wherein an opening ratio of the plurality of through-holes in the flow path forming surface is 0.01 to 10%.

8. The silencing device according to claim 1, wherein an opening ratio of the plurality of through-holes in the flow path forming surface is 0.01 to 10%.

9. A method for manufacturing a silencing device provided on a wall surface of a flow path through which a fluid flows in a rotary machine, the method comprising:

a step of preparing a plurality of plate members having a flow path forming surface forming the wall surface;

a step of forming a plurality of fine through-holes with a diameter of 0.01 mm to 0.5 mm by etching in each of the plurality of plate members;

a step of forming a flow path forming plate by stacking the plurality of plate members in a state where the plurality of fine through-holes communicate with each other and by integrally joining the plurality of plate members; and a step of forming a cavity defining portion defining a cavity on a reverse surface side of the flow path forming plate, the reverse surface being located on a reverse side of the flow path forming surface, wherein the cavity is defined by a plurality of plate-shaped outer peripheral plate members being stacked with respect to the flow path forming plate in the step of forming the cavity defining portion.

* * * * *